United States Patent [19]

Schnarr et al.

[11] 4,414,703

[45] Nov. 15, 1983

[54] DOOR CLOSER AND HOLDER

[75] Inventors: Raymond H. Schnarr; Richard L. Zunkel, both of Princeton, Ill.

[73] Assignee: Schlage Lock Company, San Francisco, Calif.

[21] Appl. No.: 298,477

[22] Filed: Sep. 1, 1981

[51] Int. Cl.[3] ..... E05F 3/12; E05F 3/20

[52] U.S. Cl. ..... 16/52; 16/56; 16/62; 16/64; 16/69

[58] Field of Search ..... 16/52, 58, 64, 69, 79, 16/85, DIG. 9, 62, DIG. 10, 56, DIG. 21

[56] References Cited

U.S. PATENT DOCUMENTS

| | | | |
|---|---|---|---|
| 3,220,047 | 11/1965 | Flint | 16/62 |
| 3,852,846 | 12/1974 | Slaybaugh | 16/62 X |
| 3,934,307 | 1/1976 | Lasier et al. | 16/62 X |
| 4,115,897 | 9/1978 | Zunkel | 16/62 X |
| 4,234,996 | 11/1980 | Jentsch | 16/62 X |
| 4,263,694 | 4/1981 | Jentsch | 16/62 X |

*Primary Examiner*—Mark Rosenbaum

*Attorney, Agent, or Firm*—Lothrop & West

[57] ABSTRACT

A door closer and holder has cylinders with pistons therein responsive to the relative swinging motion between a door panel and a door frame. A spring is loaded by door opening and acts against one piston to effect door closing. Various hydraulic passages opening into the cylinders have valves therein to control the door panel opening and closing speed or speeds. One of the valves, electrically operated, allows the door panel to close from a hold-open position.

4 Claims, 6 Drawing Figures

DOOR CLOSER AND HOLDER

BRIEF SUMMARY OF THE INVENTION

A door panel hinged in a door frame is movable under the control of a door closer and holder having a hydraulic cylinder structure in which pistons reciprocate pursuant to the door panel movement. A spring urges the door panel toward closed position. Hydraulic fluid displaced by door panel movement flows through various passages controlled by restrictions, some of them adjustable, and by an electrically controlled valve restricter. The door panel can easily be held in open position, and also can be released and travel toward closed position at a controlled rate or rates. Further, the door panel opening movement is controlled as to opening rate at least in part of its motion.

DETAILED DESCRIPTION

Figures 1, 2, 3:
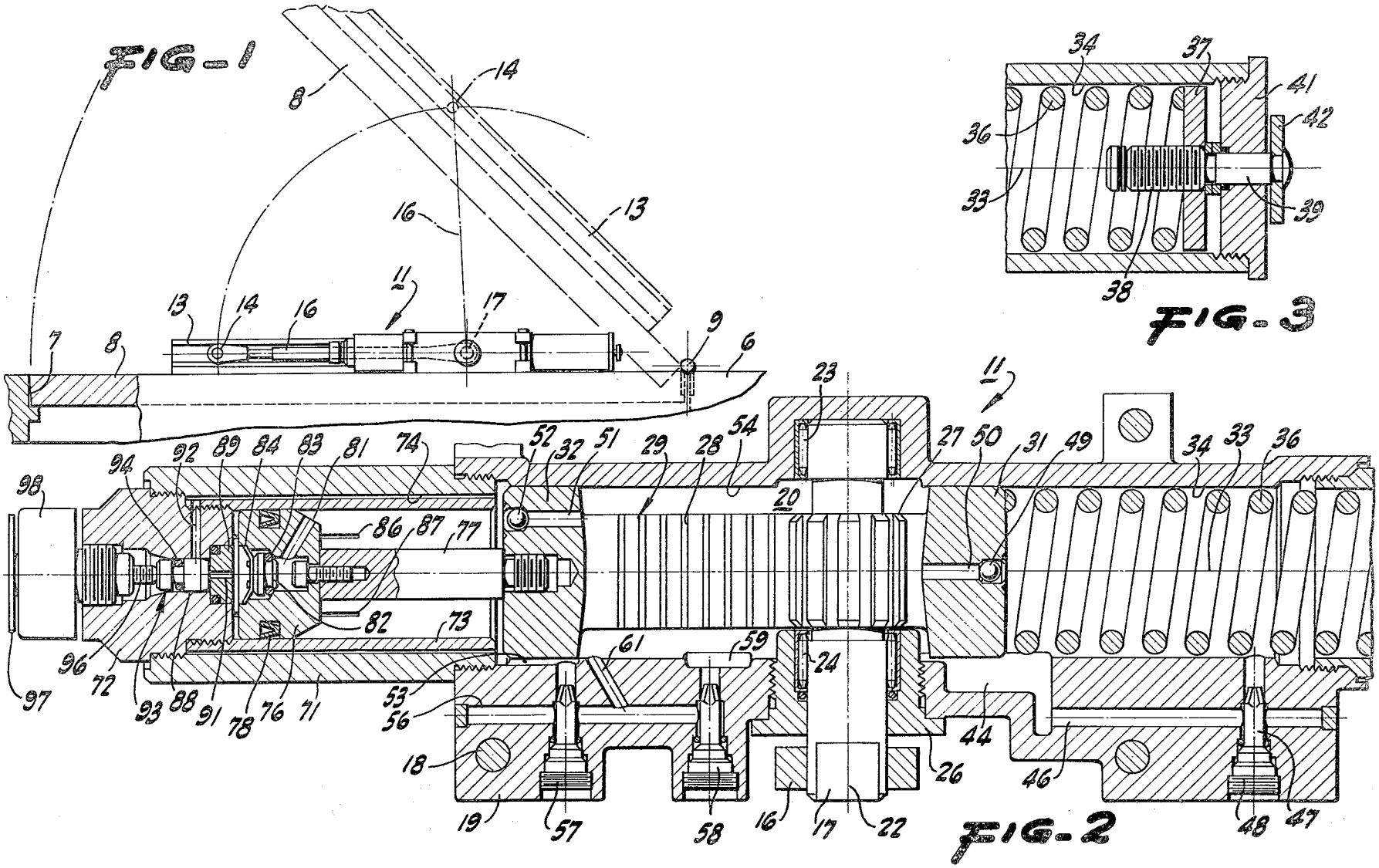
FIG. 1 is a plan view, portions being in horizontal cross-section, of a door closer and holder on a door panel and door frame, showing various positions of the parts.
FIG. 2 is a cross-section of the closer and holder, the plane of section being indicated by the line 2—2 of FIG. 1, a portion of the structure being broken away and shown in FIG. 3, which is an extension of FIG. 2.
Figure 5:
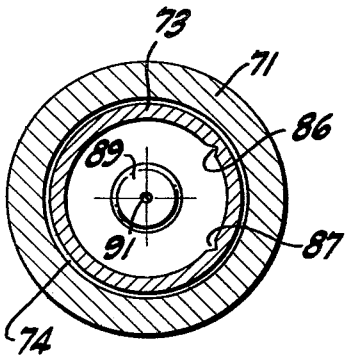
FIG. 5 is a cross-section, the plane of which is indicated by the line 5—5 of FIG. 4.

Although buildings differ and door panel installations therein also differ substantially, in a typical instance a building includes a wall 6 having a door opening 7 therein adapted to receive a door panel 8 designed to swing with respect to the wall 6 about a hinging axis 9.

Pursuant to the invention, there is particularly mounted on the wall 6 and the door panel 8 a door closer and holder 11. Included as an operating part of the closer and holder is a track 13 usually secured to the door panel and receiving the actuating end 14 of an arm 16 joined to the rotary actuating shaft 17 of the wall-mounted closer 11.

When the door panel is closed, the parts are disposed in the position shown by the solid lines in FIG. 1. As the door is opened, the arm 16 is swung through various angles until finally with the door open the arm 16 is in a position as illustrated by the broken lines in FIG. 1.

The door closer 11 is appropriately secured to the door frame by bolts 18 and preferably includes a housing 19, usually a casting, having a wall that particularly provides a central chamber 20. Journalled in the housing is the cross shaft 17 adapted to rotate about a cross axis 22. At one end an anti-friction bearing 23 supports the shaft in the housing 19, and at the other end a similar roller bearing 24 in a removable plug 26 threaded into the housing supports the shaft 17. The arm 16 is nonrotatably secured to the flattened end of the shaft 17. On that shaft is a pinion 27 disposed in the central chamber 20 and designed to mesh the rack teeth 28 on a rack 29 extending between and merging with an opening piston 31 at one end thereof and a closing piston 32 at the other end thereof.

The opening piston 31 reciprocates along a longitudinal axis 33 within an opening cylinder 34 included in the main housing 19. Disposed in the opening cylinder 34 is a coiled closing spring 36 abutting the piston 31. The spring also abuts, as shown in FIG. 3, a disc 37 mounted on a threaded and pinned shaft 38 having a journal 39 rotatable in a closure head 41 threaded into and sealing the end of the opening cylinder 34. An adjusting wheel 42 is fast on the shaft 38. By rotating the adjusting wheel, inner and outer axial adjustment of the plate 37 is made and the result is compression or expansion of the spring 36. With this arrangement, as the door panel 8 is opened, the rotation of the pinion 27 is such as to effect compression of the spring 36. Comparably, when the spring 36 is free to act, its expansion rotates the shaft 17 in such a direction as to close the door panel 8.

It is usually desired to have some restraint on the opening movement of the door panel, at least in some portion thereof. Consequently, the interior of the closer is substantially filled with hydraulic fluid such as oil. The central chamber 20 is enlarged to afford a pocket 44. This, in effect, permits free flow of hydraulic fluid around the piston 31 for a portion of the piston travel. The pocket 44 merges with a shunt passage 46 reentering the opening cylinder 34 at an intermediate point of its length. In the shunt passage there is a metering or needle valve 47 of an adjustable nature, the valve having a screw thread mounting 48 in the housing wall 19.

By manually regulating the screw valve 47, the area for flow through the shunt passage 46 can be altered. Thus, when the opening piston 31 travels beyond the pocket 44, hydraulic fluid within the opening cylinder 34 is trapped except for a throttled flow past the valve 47 and back to the central chamber 20. In this way, the speed of opening of the door panel, although not controlled or regulated in the initial portion of its movement, is damped or restricted in the final portion thereof. Return motion of the opening piston 31 when the door is being closed by the spring 36 or by manual force causes hydraulic fluid to flow back from the central chamber 20 not only through the pocket 44, in part, but largely through a duct 50 in the piston 31 since a check valve 49 therein is then open, by differential liquid pressure.

The effect of the closing piston 32 at the other end of the rack bar 29 is not restrictive in the opening movement of the door panel. A passage 51 through the closing piston 32 is made available by a then-open check valve 52 in the passage. In the other direction of motion of the closing piston 32, that check valve is closed by hydraulic differential pressure.

There is an enlargement 53 at the end of a closing cylinder 54. This closing cylinder is comparable to the opening cylinder 34 and extends coaxially therewith. A bypass passage 56 in the wall 19 affords communication between the enlargement 53 and the central chamber 20. A manually adjustable needle 57 or regulating valve variably obstructs flow between the bypass passage 56 and the enlargement 53. A similar adjustable needle valve 58 varies the resistance to flow between an enlargement 59 of the closing cylinder 54 and the passage 56. Intermediate the valves 57 and 58 in the wall 19 is a duct 61 extending between the bypass passage 56 and the closing cylinder 54.

In the opening movement of the closing piston 32, the piston traverses the enlargement 53, the duct 61, and the enlargement 59, but such travel is immaterial in the opening direction, for the check valve 52 is opened by differential pressure and there is virtually unrestricted flow through the passage 51 in the closing piston 32.

In the closing movement of the door 8 from fully open position, the closing piston 32 moves toward the left in FIG. 2 from a position substantially over the enlargement 59, and so fluid must shunt the piston 32 back to the central chamber 20. The check valve 52 is closed, so return flow goes past the needle valve 57 and in parallel through the duct 61 into and through the passage 56. Flow is then through the needle valve 58 and to the other side of the piston 32 through the enlargement 59 and so back to the central chamber 20. The needle valve 58 thus largely governs the initial closing movement. Toward the final closing movement, the piston overtravels the duct 61 and outflow is thus solely through the needle valve 57. The final closing movement flow back to the central chamber 20 is thus controlled by the needle valve 57.

In order to afford a particular hold-open and release structure, the housing 19 is extended by a tube 71 at one end screwed into the housing and at the other end thereof carrying a threaded plug 72. Mounted on the plug is an internal sleeve 73 coaxial with the tube 71 and with the closing cylinder 54. The sleeve 73 is spaced from the tube 71 to allow an annular passageway 74 therebetween.

Figure 4:
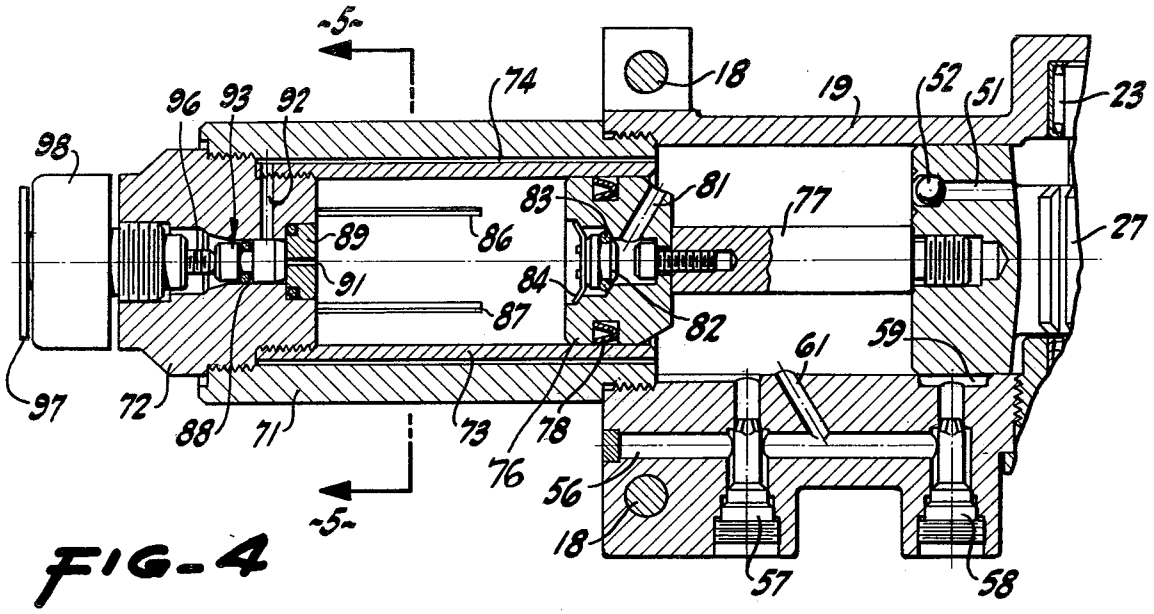
FIG. 4 is a view of the left-end portion of the structure as shown in FIG. 2, but with some of the internal parts in a different position.

Designed to reciprocate within the sleeve 73 is a main plunger 76 having a rod 77 connecting the main plunger to the closing piston 32 for movement in unison. The main plunger 76 carries an anti-leaking packing ring 78. Hydraulic fluid shunts the main plunger one-way. A central and radial passageway 81 goes through the piston. Flow is under the control of a check valve 82 (FIG. 4) carrying an O-ring 83 and positioned by a spider 84. When the main plunger 76 moves toward the right in FIG. 2, in the door opening direction, hydraulic fluid can flow through the main plunger by displacement of the valve 82. In the opposite direction of movement, the valve 82 is closed by differential hydraulic pressure and there is no flow through the main plunger 76.

For a part of the movement of the main plunger 76 within the sleeve 73, hydraulic fluid can bypass the main plunger. This occurs through some form of sleeve enlargement. For a limited axial length the diameter can be uniformly enlarged, but in this instance there are relatively small wall grooves 86 and 87 extending for a part only of the travel of the main plunger. Thus, for a part of the main plunger motion, there is a restricted hydraulic flow around the main plunger in both directions, but for another part of the main plunger travel, away from the grooves 87, there is no external hydraulic flow around the main plunger.

Special means are provided for a releasable hold-open function. The plug 72 has a central, compound bore 88 securely carrying a metering disc 89 having an upstanding bead 90 (FIG. 6) around a calibrated aperture 91 therethrough and open to the interior of the sleeve 73. Communicating with the bore 88 is a radial duct 92 not only in the plug 72 but also through the sleeve 73 and open to the annular space 74 between the sleeve and the tube 71.

In the compound bore 88 is an auxiliary plunger 93 carrying an O-ring 94 and freely movable under differential hydraulic fluid pressure except as restrained in one direction by an armature stem 96 fastened on an armature disc 97 of an electrical solenoid coil 98 itself screwed into the plug 72.

Figure 6:
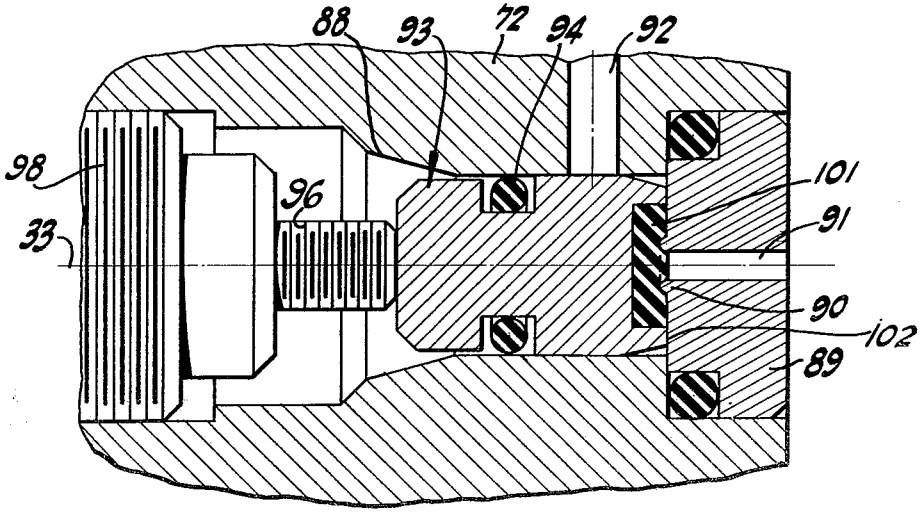
FIG. 6 is an enlarged cross-section on an axial vertical plane through a portion of the mechanism at the left end of FIG. 2.

As the door panel is opening and the plunger 76 moves toward the right in FIG. 2, hydraulic fluid flows through the then-open check valve 82 toward the space between the plunger 76 and the plug 72. Such fluid would tend to flow through the opening 91, except that normally the solenoid 98 is energized and the armature stem 96 maintains sufficient pressure on the auxiliary plunger 93 to keep the opening 91 closed. As shown in FIG. 6, the auxiliary plunger 93 carries a special deformable seat 101 so that the passageway 91 is positively sealed when the solenoid 98 is energized. However, the seat 101 is not of full diameter, but rather leaves a surrounding hard annulus 102. In closed position, this annulus hard abuts the hard disc 89 and serves as a positive axial stop, thus preventing the external solenoid armature disc 97 from abutting the solenoid coil 98 and so rendering the holding force unpredictable.

When the door is in a substantially open or full-open position and the solenoid 98 is energized, a large amount of fluid is trapped between the plunger 76 and the plug 72. This is effective to maintain the door panel against normal dislodgment from a nearly open or fully open position. If, however, a substantial manual force is exerted on the open door panel urging it toward closed position and so augmenting the force of the spring 36, the extra hydraulic pressure on the auxiliary plunger 93 is sufficient to crack the valve seat 101 open even against the electrical force of the solenoid 98. This permits fluid to flow through the aperture 91 and the duct 92 and so through the annular passageway 74 to permit a forced but regulated door closure. As the door panel moves far enough away from fully open position so that the plunger 76 is shunted by the passages 86 and 87, then the manual forced closure is less restricted.

Whenever the door panel is to be opened fully or partly, the force of the solenoid 98 is eliminated by opening the electrical circuit thereto. Then there is no longer any force endeavoring to keep the auxiliary plunger 93 closed. The door panel can then swing closed under the force of the spring 36 and with the control remaining due to the metering valves 57 and 58 effective upon the piston 32.

In this fashion there has been provided a door closer and holder effective to regulate a part of the opening movement of the door panel, to afford various regulations of the closing movement of the door panel, to provide an electric hold-open function for the door panel, and to interrupt the hold-open function and permit door closure under normal regulation.

We claim:

1. A door closer and holder comprising a housing having a central chamber and a closing cylinder communicating with each other, a closing piston reciprocable in said closing cylinder, a sleeve extending said closing cylinder, a plunger reciprocable in said sleeve, means for connecting said plunger and said closing piston for movement together, a plug engaging said sleeve, said plug having a compound bore, a metering disc in said plug and opening into said compound bore and the interior of said closing cylinder, an auxiliary plunger reciprocable in said compound bore between a closed position in abutment with said metering disc and an open position out of abutment with said metering disc, an armature stem axially movable in said compound bore and disposed with one end in abutment with said auxiliary plunger, an armature disc fast on the other end of said armature stem, a solenoid coil surrounding said armature stem, and means mounting said solenoid coil on said plug for axial movement toward and away from said armature disc.

2. A door closer and holder as in claim 1 in which said metering disc includes an axial opening, an upstanding bead surrounding said opening, an annulus on said auxiliary plunger adapted to abut said metering disc, and a deformable seat on said auxiliary plunger surrounded by said annulus and adapted to abut said bead.

3. A door closer and holder as in claim 1 in which said armature disc is spaced from said solenoid when said armature stem abuts said auxiliary plunger.

4. A door closer and holder as in claim 1 including means for mounting said solenoid coil rotatably on said plug and for relative axial movement toward and away from said armature disc.

* * * * *